US007110884B2

(12) United States Patent
Tritico et al.

(10) Patent No.: US 7,110,884 B2
(45) Date of Patent: Sep. 19, 2006

(54) METHODS IN THE ENGINEERING DESIGN AND CONSTRUCTION OF EARTHEN FILLS

(75) Inventors: Philip A. Tritico, Katy, TX (US); Ronald E. Langston, Houston, TX (US)

(73) Assignee: Earthworks Solutions, Inc., Houston, TX (US)

( * ) Notice: Subject to any disclaimer, the term of this patent is extended or adjusted under 35 U.S.C. 154(b) by 194 days.

(21) Appl. No.: 10/924,132

(22) Filed: Aug. 23, 2004

(65) Prior Publication Data

US 2005/0019105 A1 Jan. 27, 2005

Related U.S. Application Data

(63) Continuation-in-part of application No. 10/244,998, filed on Sep. 16, 2002, now Pat. No. 6,859,732, which is a continuation of application No. PCT/US01/15638, filed on May 15, 2001.

(51) Int. Cl.
*G01N 33/24* (2006.01)

(52) U.S. Cl. ..... 702/2

(58) Field of Classification Search ..... 702/2, 702/41; 73/866, 818, 819, 9, 32 R, 38, 73, 73/84, 784; 405/271
See application file for complete search history.

(56) References Cited

U.S. PATENT DOCUMENTS 4,270,875 A * 6/1981 Kainuma ..... 405/271 X
4,436,556 A * 3/1984 Kadelka ..... 106/697
5,090,843 A * 2/1992 Grigsby ..... 405/129.9
5,105,650 A * 4/1992 Atkinson et al. ..... 73/784 X
5,402,667 A * 4/1995 Atkinson et al. ..... 73/866 X
5,426,972 A * 6/1995 Heirtzler et al. ..... 73/84
5,675,090 A * 10/1997 Nishida et al. ..... 73/866 X
5,756,907 A * 5/1998 Senda et al. ..... 73/866
6,757,642 B1 * 6/2004 Boudreau et al. ..... 73/784 X
6,826,498 B1 * 11/2004 Birkner et al. ..... 702/84
6,973,821 B1 * 12/2005 Corcoran ..... 73/78
2005/0158129 A1 * 7/2005 Chi et al. ..... 405/271

* cited by examiner

*Primary Examiner*—Thomas P. Noland
(74) *Attorney, Agent, or Firm*—Martin L. McGregor

(57) ABSTRACT

The invention is a composite of interdependent engineering methods for earthen fill engineering and construction. The invention includes the development, utilization, and correlation of actual, cumulative field compaction energies, unique to and based on field combination-specific variables of any combination but including all of the following: soil type, compactor type, lift thickness, moisture content, and soil amendment type and mix. Interdependent development of the field combination-specific compaction energies includes the following combination-specific steps: novel rolling resistance energy versus dry density field trials, novel generation and direct curvalinear utilization of parabolic rolling resistance energy curves with roller passes, novel determination of asymptotic energy-density approach ranges, novel selection and application of percentage density sectors on novel moisture-density curves, and novel projection of said percentage density sectors onto corresponding roller compaction energy curves for selection and use of design compaction energy levels. Interdependent correlation of the combination-specific energy values is made with all physical and engineering properties of all soil types and amended soil types in the compacted state that corresponds to and is the product of the specific combination of field variables. In addition to interdependent utilization of the energy and corresponding engineering properties in method development, the energy and corresponding engineering properties are tabulated within cross-matrices of all field combinations for use in engineering design, laboratory compaction testing, and construction controls. The cross-matrix values are related in a manner that permits determining values for additional field combinations that have not been tested on a full scale.

23 Claims, 1 Drawing Sheet

METHODS IN THE ENGINEERING DESIGN AND CONSTRUCTION OF EARTHEN FILLS

RELATED APPLICATION

This application is a continuation in part of provisional application Ser. No. 10/244,998 filed Sep. 16, 2002 now U.S. Pat. No. 6,859,732, which was a section continuation of PCT International application Number PCT/US01/15638 Filed 15 May 2001.

TECHNICAL FIELD

This invention encompasses new methods for and in earthen fill engineering and construction and includes application to treated and amended soils for subgrades and base courses. More specifically this invention involves new and different methods to determine, use, and model in the laboratory, actual field compaction energy generated by all combinations of compactors, soil types, lift thickness', moisture contents, and soil amendments; and the application of these methods in engineering design, specification, and construction control methods, based on methods to derive and correlate rolling resistance energy, cumulative compaction energy, soil moisture, density, and geotechnical engineering properties.

BACKGROUND OF THE INVENTION

In current engineering practice, the specification and control of density and moisture of earthen fill is typically based on the results of the Standard Proctor compaction test (American Society for Testing Materials [ASTM] D698) or the Modified Proctor compaction test (ASTM D1557), or other similar test standards derived from the Proctor tests and established by other institutes and governments (i.e. AASHTO, etc;). All standard tests used in practice utilize fixed soil compaction energies. The compaction energy used in the standard proctor compaction test is 600 kilonewton-meter per cubic meter Kn-m/$m^3$ or 12,400 foot pounds per cubic foot (ft-lbs/cf). The other standard tests based on the Standard Proctor Test use the same or comparable fixed energy levels. These standard tests are based on work by R. R. Proctor, who estimated field compaction energies of towed compactors (or rollers) used in the early 1930's. These fixed compaction energy levels were based on drawbar pull values measured with towed compactors, and considered to be somewhat representative of field compaction energies. Subsequently, it was found that high fills constructed by using the standard proctor energy experienced substantial compression under their own weight. This fill compression combined with the development of aircraft and truck traffic with heavier wheel loading led to the development of the modified proctor compaction test by R. R. Proctor. Hunt, R. E. (1986) *Geotechnical Engineering Analysis and Evaluation*, McGraw-Hill Book Co., p.211. The compaction energy used in ASTM D1557 (2,700 Kn-M/$m^3$, or 56,000 ft-lbs/cof) is about 4.5 times higher than the compaction energy used in ASTM D698.

Even in the 1930's and 1940's it was recognized that the laboratory compaction tests produced energies that were inconsistent with field compaction energies. Numerous attempts were made to develop test procedures that produced field and laboratory compaction (moisture-density) curves that would be more comparable. The present inventors have published a very basic approach to improved procedures: 1.) "Practice Improvements for the Design and Construction of Earth Fills", Proceedings of the Eighth Annual Conference on Contaminated Soils, University of Massechusetts at Amherst, 1994; and Geoenvironment 2000 Conference, New Orleans, La., 1995; and 2.) "Practice Improvements for the Design and Construction of Earth Fills", Proceedings of the Texas Section Fall Meeting, 1995, American Society of Civil Engineers, El Paso, Tex. There has not previously been available in the art practicable methods to derive actual cumulative field compaction energies unique to each site based on soil/compactor/lift thickness/moisture/soil amendment combinations, a data matrix developed to provide actual field combination-specific compaction energy levels and engineering property correlations based on variable soil/compactor/moisture/lift thickness combinations, or to allow extrapolation for intermediate combinations or compaction conditions, with or without field data, or to select field-specific compaction energy levels to be applied in laboratory tests or utilized in engineering methods, rather than the fixed energies of the standard test methods described above. The new improvements provide a different method for modeling of actual, combination-specific field compaction energies in the laboratory that are not fixed, and provide for design applications and specifications, and construction, for all types of compactors combined with all classes of earthen fills (having a suitable fines fraction) moisture states, lift thickness', and soil amendments.

SUMMARY OF THE INVENTION

The invention provides for a different method for determining compaction energy and associated moisture-density/engineering property relations for any given combination of soil type, compactor, moisture state, lift thickness, and soil amendment, by tracking energy distribution, determining field-specific rolling resistance and correlating such determinations to cumulative compactive energy loss and engineering properties of the compacted lift, under practical and controlled construction conditions. The invention establishes these different methods by including lift thickness, soil moisture content, and soil amendments with the soil/compactor combinations, as opposed to any methods based solely on soil/compactor combinations, and by including other methods that differ from prior art. The different methods include determining the unit cumulative compactive energy per unit volume at the asymptotic energy-density approach for each rolling resistance field trial by using the cumulative average rolling resistance according to each parabolic data curve, in contrast to the prior published method (Tritico/Langston, 1994,1995) of using the cumulative linear average rolling resistance. The invention provides a method for establishing engineering control in construction and determining actual, cumulative field compaction energy and associated engineering property relationships for a given soil type, the improvement that comprises for a selected compactor type, determining the energy transferred to the soil by measuring rolling resistance as a function of rimpull energy performance, plotting the variation of rolling resistance and soil density for a given soil moisture content for a plurality of roller passes, determining the combination-specific, asymptotic energy-density approach range, determining the cumulative average rolling resistance for selected points within said asymptotic energy-density approach range, and determining design energy levels, establishing and locating site-specific moisture-density curves and relating those curves to laboratory test compaction curves. The different methods further include determining the "design energy level" for laboratory modeling based on establishing a specific percentage density sector of the derived moisture-density curves at or within the asymptotic energy-density approach, which is projected onto a corresponding roller compaction energy curve, in contrast to the prior art of selecting a random energy value based on visual observation of energy-density-moisture graphs. The specific density sector method involves a specific percentage value selected within the range of 85 to 100% of the maximum density values on the derived moisture-density curves at or within the asymptotic energy-density approach projected onto corresponding roller compaction energy curves. The selected percentage density sector is projected onto a corresponding roller energy curve selected from the group of curves at or within the asymptotic energy-density approach. The new method further includes determination of the asymptotic energy-density approach based on combination-specific results of full-scale field trials including all combinations of lift thickness, soil type, soil amendments, moisture content, and compactor type, as opposed to the prior art of a generalized asymptotic energy-density approach of an 8–10 or 8–12 pass range based solely on the soil/compactor combination, and conventional expectation. The different, specific methods operate together to define the new method. The method may be applied to specific compactors such as determining the actual, cumulative field compaction energy for a Cat 815B compactor for a given soil, such as type CH, with a certain moisture state, lift thickness, and soil amendment type, and correlation, use and control of resultant engineering properties for new engineering and construction methods.

In another embodiment the invention provides a data matrix of field combination-specific compaction energy correlation factors for various combinations of soil type, soil amendment, moisture content, lift thickness, and compaction rollers, developed with the new methods, and uses of the established data matrix to determine field-specific compaction energy correlations for an untested field combination. The data matrix may be used in conjunction with other improvements to extrapolate from known values to untested field combinations based on extrapolation of data for tested soils or equipment. The invention may also be viewed as a data matrix comprising a set of actual field compaction energy correlation factors for various soil densities, moisture contents, and other engineering properties for a plurality of soil types, a plurality of soil compactors, a plurality of lift thickness', a plurality of soil amendments, or a plurality of all the above. The invention includes new engineering and construction methods which utilize a data matrix to provide an alternate method for computing design compaction energy, for laboratory modeling, engineering design and specifications, and/or construction testing and controls, and includes extrapolations and/or interpolation of established data in the data matrix. The new methods include generation of the data matrix based on the new methods outlined above and novel methods for determining specific asymptotic energy-density approach ranges from data sets of rolling resistance trials based on field-specific combinations of soil types, compactors, moisture contents, lift thickness', and soil amendments. The new method includes utilization of asymptotic energy-density approach ranges, constituting ranges of 2 to 5 passes, from within the group of 6 to 20 passes, as opposed to a sole soil/compactor combination basis, or generalization of an 8–12 or 8–10 pass range. The invention may also be viewed as a data matrix, based on and utilized as and a part of, the new and different methods outlined herein, comprising a set of field combination-specific rolling resistance energy correlations for a plurality of soil types, compactors, lift thickness', moisture contents, and soil amendments, and relating associated maximum soil densities, optimum moisture contents, and other engineering properties, and the data is displayed or used for new engineering and construction control methods, and in a manner that permits determining values for additional field combinations by extrapolation, or actual field trial.

DETAILED DESCRIPTION OF THE INVENTION

Definitions

Figure 1:
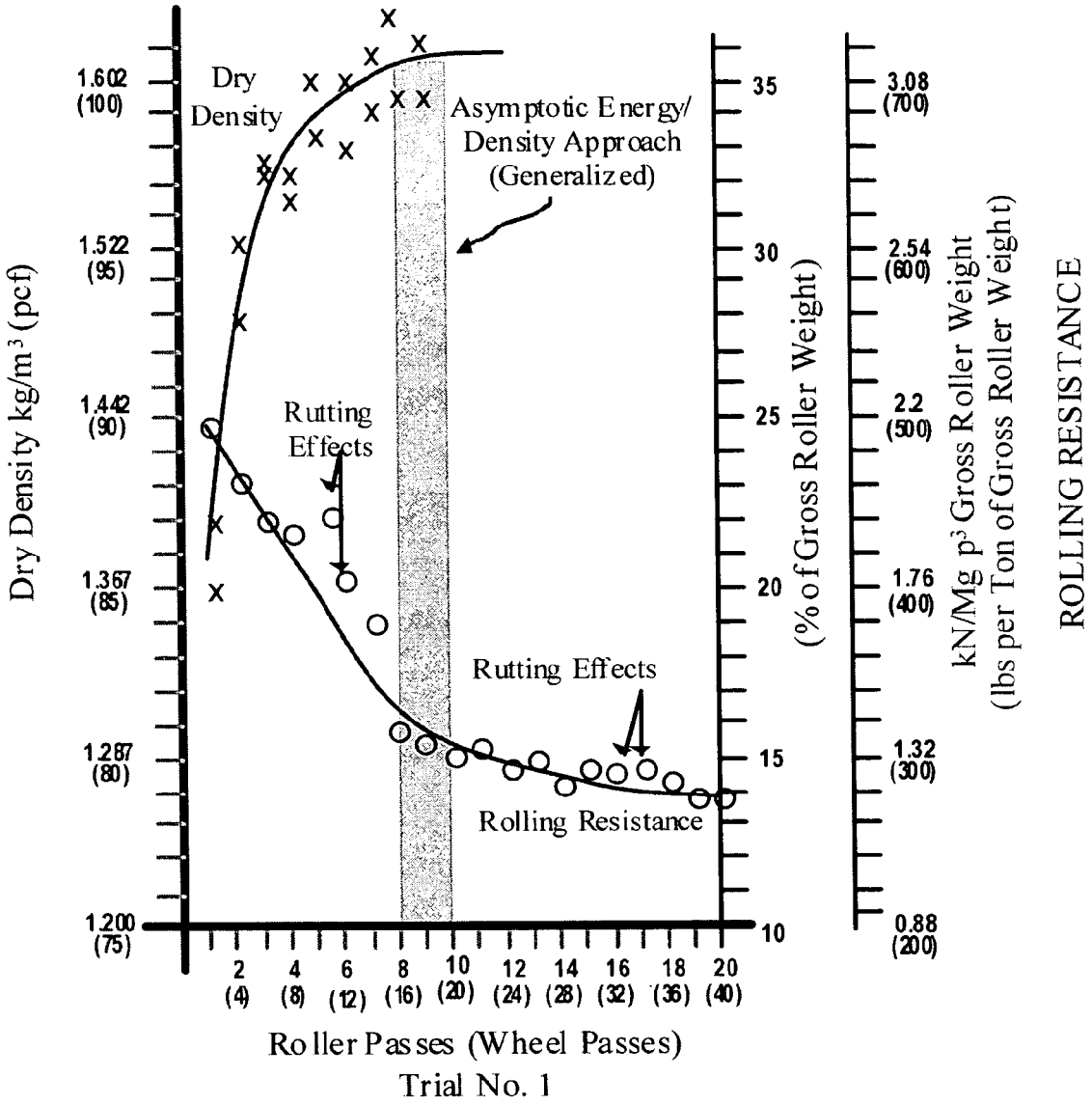
FIG. 1 is a plot of the change in rolling resistance and density with roller passes for a Caterpillar Model 815B compactor for a typical field trial.

"ASTM" means American Society for Testing Materials.

AASHTO means American Association of State Highway and Transportation Officials

Compaction Energy means the energy component that is transferred by a compaction roller into the ground over which it is travelling, and represents the energy that causes soil densification.

"Asymptotic Energy-Density Approach" means a segment of a data set of roller passes wherein the incremental change in rolling resistance and corresponding soil densification begins to be insignificant with successive roller passes.

"Best fit curve" means the curve plotted through a set of data points that best fits the data trends and variations by methods of bilinear or curvilinear approximation or averaging, and educated visual extrapolations.

"Cumulative average rolling resistance" means the rolling resistance measured by the method of example 2 below.

"Design energy level" means a cumulative compaction energy level considered to be representative of actual field energies produced by compactor-soil-moisture-lift thickness-soil amendment combinations, at a select point within the asymptotic energy-density approach in a practical, controlled environment, and to be applied to engineering uses including laboratory compaction testing. In laboratory compaction testing, the energy is utilized in testing of a soil sample using the apparatus of a Standard or Modified Proctor test (or other similar apparatus') by varying the fixed energy specified in the standard test procedures to utilize the design energy.

"Rolling resistance" is defined as the fraction of rimpull energy needed to overcome energy loss into the earthen lift being compacted, as determined using compactor rimpull curves provided by the equipment manufacturer.

GENERAL DESCRIPTION OF THE INVENTION

FIG. 1 represents a basic, prior art illustration of rolling resistance vs. soil densification with roller passes, produced by a given soil-compactor combination. As reflected in the figure, rolling resistance reduces, as the soil densifies with each roller pass. Both rolling resistance and soil density reach asymptotic states at the same rate. This effect is the result of decreasing soil deformation with increasing compaction.

The inventors published that compaction energy transferred from a wheel-ground system is a function of rolling resistance and that rolling resistance is a function of the compactor's rimpull energy. The rimpull energy of a given roller wheel is considered to be a more suitable parameter for determination of field compaction energy than the compactor's drawbar pull parameter as used by R. R. Proctor in the development of standard methods.

The invention encompasses new and different methods for determining actual, cumulative field compaction energy based on rolling resistance measurements as a function of rimpull energy, and by relating rolling resistance to compactor type, dry density, moisture content, lift thickness, soil type, and soil amendments, with each roller pass; as opposed to measuring rolling resistance or estimating compaction energy based on just a soil/compactor combination with each roller pass. The invention includes a method for establishing engineering control in construction and determining actual, cumulative field compaction energy and associated engineering property relationships for a given soil type, the improvement that comprises for a selected compactor type, determining the energy transferred to the soil by measuring rolling resistance as a function of rimpull energy performance, plotting the variation of rolling resistance and soil density for a given soil moisture content for a plurality of roller passes, determining the combination-specific, asymptotic energy-density approach range, determining the cumulative average rolling resistance for selected points within said asymptotic energy-density approach range, and determining design energy levels, establishing and locating site-specific moisture-density curves and relating those curves to laboratory test compaction curves. The invention includes the correlation of engineering properties of compacted soils to the actual cumulative compaction energy levels, as opposed to fixed energy levels and standard practices. The invention also includes methods for and of the development and utilization of data matrices of these correlations in and for different engineering design, construction, and construction testing and control methods, as opposed to standard practices.

EXAMPLE 1

In a field test program the rolling resistance of a wheel/ground system suitable for earthen fill construction is measured relative to soil type, compactor type, soil lift thickness, moisture content, dry density, soil amendments, and roller passes. A specific test pad design is built with a certain soil type at different loose lift thickness', moisture contents, and soil amendments. Various earthwork compactors are used for the test and the compactor's performance parameters and specifications are recorded. The field test program consists of a series of at least three test trials. For each lift thickness, initial moisture content, soil type, soil amendment, and compactor type, each trial involves the determination of rolling resistance, soil dry density, and soil moisture content with each roller pass, and other engineering properties at and within the asymptotic energy-density approach range. Each trial is conducted with a different initial moisture content in order to test a range that encompasses the true optimal moisture content for the energy being applied, and to test for specific moisture contents for correlation with certain engineering properties based on soil type and for purposes of engineering design requirements and the new engineering methods. Each trial is continued until changes in field measurements are clearly in an asymptotic state and the approach range is clearly defined. Rolling resistance is measured based on test pad configuration and rimpull performance using rimpull performance curves for the test compactors. The data from each trial are plotted in a manner similar to that shown in FIG. 1 or the asymptotic range may be determined by any other mathmatical method for finding such a variable. Rolling resistance is based on measurement of rimpull energy performance in each test trial. Best fit curves of dry density vs. rolling resistance with each roller pass are developed in graphical or tabular form. Based on the combination-specific results in the plots, for each trial, novel asymptotic energy-density approaches are determined as a range composite of 2 to 5 passes, within a pass range of 6 to 20 passes; as opposed to generalization of an 8–10 or 8–12 pass range based solely on a soil/compactor combination. The methods include selecting a pass interval in the novel asymptotic energy-density approach, to determine cumulative average compaction energy levels in order to determine a "design compaction energy" (or a select unit cumulative compaction energy per unit volume) from combination-specific moisture-density, and moisture-energy curves, based on and for use in novel methods. Selection of the pass interval in the novel asymptotic range is based on the project-specific criticality and factor of safety intents in practical application of the methods. The prior art (published by the current inventors) for determination of the "design energy level" was based on selecting a random, generalized energy value based on visual observation and averaging of energy-density-moisture graphs, based solely on a soil-compactor combination, at a generalized asymptotic energy-density approach of 8–10 passes. The novel "design energy levels" are determined based on the multitude of field combinations and resultant asymptotic approach intervals and used for modeling in laboratory compaction testing, and correlation with engineering properties of corresponding compacted lifts. These data are correlated for the development and utilization of a data matrix of field combinations, and to provide new engineering and construction control methods based on using the data matrix to derive engineering specifications that will more nearly match field results than do prior art methods. The method correlates observed field combinations that include soil type, compactor type, lift thickness, moisture content, and soil amendments; as opposed to measurements based only on soil type and compactor type as suggested in the prior art. The invention also enables establishing and locating site-specific moisture-density curves and relating those curves to laboratory test compaction curves.

EXAMPLE 2

The invention includes a method for computation of cumulative average rolling resistance for each field trial from the best fit parabolic data curve formed by the trials. This is accomplished as follows:

For each rolling resistance vs. dry density curve produced by plotting the measured results for several data points in each pass of each field trial, new compaction data is drawn directly from the best fit, parabolic curve formed by plotting the rolling resistance variance with roller passes. Along the line of the curve, rolling resistance values for each wheel pass are drawn directly from the curve, for cumulative averaging. The cumulative averages are made with values taken from the first wheel pass up to the select pass at or within the novel asymptotic energy-density approach. The cumulative averages representing values at the novel asymptotic energy approach are then used for computing unit cumulative compaction energy per unit volume or "design compaction energy" values. This method contrasts with the prior art method of linear averaging of cumulative rolling resistance from the curve and the generalized asymptotic energy-density approach of 8–10 passes.

EXAMPLE 3

The invention includes a method to determine the novel "design energy level" based on selection of a specific percentage density sector of the derived moisture-density curves at or within the novel asymptotic energy-density approach, which is projected onto a corresponding roller compaction energy curve. This is accomplished as follows:

Using novel curves of roller compaction energy vs. moisture content, superimposed with dry density vs. moisture content, covering the novel asymptotic energy-density approach, a specific percentage density sector is selected or "notched" out of the select or corresponding density curve(s) in order to define a "design range" of moisture contents. The specific percentage value is selected within the range of 85 to 100% of the maximum density values on the derived moisture density curves, based on engineering needs with the new engineering methods. These needs include project-specific criticality and factor of safety intents in practical application of the new methods. This "design range" per novel selection methods is then projected onto the corresponding roller compaction energy curve(s) on the same chart. The intercept sector formed by the design range projection onto the roller energy curves is then used to derive a "design energy level" by direct reading from the chart, and is used for laboratory simulation of field compaction energy and the other novel methods described herein.

EXAMPLE 4

A data matrix that cross-matches some or all combinations of compactor and soil types or amended soils, for each and any combination of lift thickness and moisture content, is developed and used in the methods of the invention. A data set within each cross-match within each matrix includes the following corresponding data values: "design energy levels" or actual cumulative field compaction energy levels covering the percentage range of selected density sectors, the asymptotic energy-density approach ranges, maximum dry density values, optimum moisture content values, energy correlation factors for laboratory testing, factor of safety values for engineering uses, and any and all engineering properties for the corresponding compacted lift product. Examples of other engineering properties are shear strength, modulus, consolidation, CBR, permeability, index properties, etc.

Using novel methods described herein, novel design energy levels and correlation factors for all said field combinations are tabulated in a cross-matrix. The factors are used as multiplying factors for modeling field compaction energy whereby the factor is used to adjust standard laboratory compaction testing to model actual, combination-specific compaction energy of earthen fill materials. Also included in the matrix are the novel asymptotic energy-density approach ranges and all other said engineering properties which correspond to the compacted lift product. The novel matrix is also used as a part of the new methods to interpolate or extrapolate between cross-matrix values for untested field combinations.

EXAMPLE 5

The novel data matrix of example 4 is also used as a part of the new method to model actual, cumulative field compaction energy (or "design energy levels") in the laboratory for production of field-representative moisture-density compaction curves, or to assess compaction energies for other engineering uses. The novel compaction energy values drawn from the novel matrix are based on the novel asymptotic energy-density approach ranges and percentage density sectors, for any combination of the novel field parameters (soil type, compactor type, lift thickness, moisture content, and soil amendment). For utilization or modeling of novel design energy levels in laboratory compaction testing, the novel energy correlation values or multiplying factors are applied to the height or number of hammer drops in the Standard or Modified Proctor Test procedures, or other standard test procedures derived from the Proctor Test standards, to model the novel compaction energy in the procedure instead of the specific fixed energy levels produced by the standard test procedures. With the modified laboratory compaction testing based on novel compaction energy values and associated methods to determine and use the energy values, field combination-specific moisture-density compaction curves are produced for practical application.

We claim:

1. In a method for establishing engineering control in construction and determining actual, cumulative field compaction energy and associated engineering property relationships for a given soil type, the improvement that comprises for a selected compactor type, determining the energy transferred to the soil by measuring rolling resistance as a function of rimpull energy performance, plotting the variation of rolling resistance and soil density for a given soil moisture content for a plurality of roller passes, determining the combination-specific, asymptotic energy-density approach range, determining the cumulative average rolling resistance for selected points within said asymptotic energy-density approach range, and determining design energy levels, establishing and locating site-specific moisture-density curves and relating those curves to laboratory test compaction curves.

2. In the method of claim 1, making additional measurements that vary at least one variable selected from the group consisting of 1) lift thickness, 2) initial soil moisture content, and 3) soil amendments.

3. The method of claim 1 that comprises the steps of 1) tracking energy distribution and isolating compaction energy transfer, 2) determining cumulative field compaction energy and corresponding engineering properties for a combination of a plurality of soil types, a plurality of compactor types, and at least one additional variable selected from the group consisting of a plurality of moisture contents, a plurality of lift thickness', and a plurality of soil amendments.

4. The method of claim 3 that further comprises providing data sets forming a data matrix comprising correlations selected from the group consisting of corresponding energy values, engineering properties, construction control parameters, roller pass control parameters, and safety factors.

5. The method of claim 4 wherein the data matrix is a cross matrix comprising compactor types used for the majority of earthen fill construction contracts in the United States, with data measured for at least one additional variable selected from the group consisting of 1) a plurality of specific soil types 2) a plurality of amended soil types, 3) a plurality of moisture content values, and 4) a plurality of lift thickness'.

6. A method of specification for earthen fill construction that comprises using data cross-matrices according to claim 5 to determine a value selected from the group consisting oft) a soil compaction specification for an earthen fill, 2) an engineering design for an earthen fill, 3) a construction control for an earthen fill, 4) a test result for construction testing, 5) a laboratory compaction test, and 6) to provide an estimate of an engineering property.

7. The method of claim 1 wherein at least three rolling resistance field trials are conducted, each trial measuring rolling resistance energy variation with dry density for a plurality of roller passes.

8. The method of claim 7 wherein the field trials factor at least one additional variable selected from the group consisting of a plurality of lift thicknesses, a plurality of initial soil moisture contents, a plurality of soil types, a plurality of soil amendment types, and a plurality of soil compactor types.

9. The method of claim 8 wherein the field trials are used to establish combination-specific and corresponding parabolic curves of rolling resistance versus dry density.

10. The method of claim 1 that further comprises determining the unit cumulative compactive energy per unit volume at a select interval at or within the asymptotic energy-density approach based on moisture-density-energy curves derived from the rolling resistance field trials and by using the cumulative average rolling resistance according to each exact parabolic rolling resistance data curve.

11. The method of claim 5 that further comprises determining the asymptotic energy-density approach based on the combination-specific results of at least three of the following field conditions: soil type, compactor type, lift thickness, moisture content, and soil amendment; and plotting the data to provide a data set of rolling resistance field trial curve formations.

12. The method of claim 1 that further comprises development of an asymptotic energy-density energy approach range that constitutes a collective sector of data forming a composite range of 2 roller passes to 5 roller passes, selected from within an overall field trial range wherein the data was measured in the range of 6 roller passes to 20 roller passes.

13. The method of claim 1 that comprises the additional step of determining the "design energy level".

14. The method of claim 1 that comprises the additional step of determining a select unit cumulative compaction energy per unit volume.

15. The method of claim 1 that comprises selection of a specific percentage density sector of a combination-specific, moisture-density curve produced from composites of the field trial data, at a select interval at or within the asymptotic energy-density approach range, and subsequent projection of the selected sector onto a corresponding roller compaction energy curve on the same chart.

16. The method of claim 15 wherein the specific percentage density sector is selected within the range of 85 to 100% of the maximum density values established on the combination-specific moisture-density curve at a select interval at or within the asymptotic energy-density approach.

17. The method of claim 16 wherein the selected percentage density sector within the 85 to 100% range is projected onto the corresponding roller energy curve from the same interval at or within the asymptotic energy-density approach.

18. The method of claim 1 wherein the actual, cumulative field compaction energy for a Cat 815B compactor combined with a CH class soil, is determined based on certain moisture contents, lift thickness', and soil amendments, included in the field combinations.

19. The method of claim 1 wherein sets of cross-matrices of actual, combination-specific, cumulative compaction energy values and correlation factors determined for any combination of all five of the following full-scale factors: soil type, compactor type, moisture content, lift thickness, and soil amendment.

20. The method of claim 11 wherein combination-specific, field and laboratory based, engineering properties, control parameters, safety factors, roller pass limits, engineering correlation factors, and laboratory test parameters are contained within the cross-matrices of soil type or amended soil with compactor type, for each lift thickness and moisture content.

21. The method of claim 1 wherein specific, combination-specific, and corresponding energy and engineering properties and correlation factors and parameters contained within the cross-matrices is utilized by interpolation and extrapolation for untested field combinations.

22. The method of claim 4 wherein the cross-matrix is used for an engineering method selected from the group consisting of: 1) engineering design and specification, 2) laboratory compaction testing utilizing standard test apparatus' to generate combination-specific moisture-density curves, 3) construction control and testing, and 4) estimating engineering parameters for untested combinations.

23. The method of claim 22 wherein engineering values drawn from the cross matrices include actual, cumulative field compaction energy levels at various asymptotic energy-density approach intervals and percentage density sectors, and the asymptotic energy-density approach range and corresponding correlation factors are used to set limits for a purpose selected from the group consisting of 1) roller passes specifications, 2) energy correlation factors for laboratory compaction testing, 3) maximum dry density values, 4) optimum moisture contents, 5) engineering strength (for corresponding energy levels and compacted states), 6) stability properties (for corresponding energy levels and compacted states), 7) permeability properties (for corresponding energy levels and compacted states), 8) wet of optimum moisture contents, and 9) safety factor values for engineering design uses.

* * * * *